US006644630B1

(12) United States Patent
Lorenz

(10) Patent No.: US 6,644,630 B1
(45) Date of Patent: Nov. 11, 2003

(54) BRAKE MECHANISM FOR WINCH ASSEMBLY

(75) Inventor: Donn H. Lorenz, Benson, MN (US)

(73) Assignee: Lorenz Manufacturing Company, Benson, MN (US)

( * ) Notice: Subject to any disclaimer, the term of this patent is extended or adjusted under 35 U.S.C. 154(b) by 0 days.

(21) Appl. No.: 10/177,902

(22) Filed: Jun. 19, 2002

(51) Int. Cl.[7] ..... B66D 5/32
(52) U.S. Cl. ..... 254/376
(58) Field of Search ..... 254/375, 376, 254/378; 74/577 R, 577 M, 577 S, 575

(56) References Cited

U.S. PATENT DOCUMENTS 635,222 A * 10/1899 Baggaley ..... 74/576
1,537,717 A * 5/1925 Van Berkel ..... 74/111
2,670,176 A * 2/1954 Coffing ..... 254/369
3,765,652 A * 10/1973 Janik ..... 254/376
4,513,952 A * 4/1985 Vandelinde ..... 254/285
4,723,757 A * 2/1988 Steinman et al. ..... 254/369
5,344,121 A * 9/1994 Baziuk ..... 254/358
5,364,074 A * 11/1994 Gourley ..... 254/375
5,787,761 A * 8/1998 Wang ..... 74/535
6,572,083 B1 * 6/2003 Topping, Jr. et al. ..... 254/375

* cited by examiner

*Primary Examiner*—Emmanuel M. Marcelo
(74) *Attorney, Agent, or Firm*—Merchant & Gould PC

(57) ABSTRACT

A winch assembly including a brake mechanism. The winch assembly may include a winch housing and a shaft extending through the winch housing. The brake mechanism of the winch assembly may include a ratchet coupled to the shaft and including a plurality of teeth and a pawl with a pawl shoulder coupled to the winch housing and engaging one of the plurality of teeth of the ratchet to lock the shaft from rotating in an unwinding direction. A pawl controller may be coupled to the shaft and include a notch to engage the shoulder of the pawl and bias the pawl away from the plurality of teeth of the ratchet when the shaft is rotated in a winding direction, thereby reducing noise associated with the pawl contacting the plurality of teeth of the ratchet.

14 Claims, 7 Drawing Sheets

BRAKE MECHANISM FOR WINCH ASSEMBLY

TECHNICAL FIELD

This invention relates generally to a winch assembly. More particularly, this invention relates to a brake mechanism for a winch assembly.

BACKGROUND

Winch assemblies are used to provide a mechanical advantage to move large or heavy objects. For example, in the boating industry, winch assemblies are used in conjunction with boat lifts to raise and lower boats out of and into the water. Winch assemblies are also prevalent throughout many other industries.

A typical winch assembly includes a shaft attached, sometimes through one or more reductions, to a spool. The spool may include an outer surface onto which a cable may be wound. The trailing end of the cable may be attached to an object, such as a boat lift. The winch assembly typically includes a ratchet with a plurality of teeth coupled to the shaft and a pawl positioned to engage the teeth to stop rotation of the shaft in an unwinding direction. The pawl thereby protects against unwinding of the cable and the undesired release of the boat or other object attached to the winch.

When the shaft is turned in the winding direction to wrap the cable onto the spool and thereby raise the boat, the pawl rides over the teeth of the ratchet, falling between each tooth as the ratchet follows the shaft in the winding direction. The action between the pawl and the ratchet generates noise. Because the pawl and ratchet are typically made of metal, the noise generated can be significant. The noise problem may be further exacerbated if the winch assembly is used in an area in which noise is undesirable.

It is desirable to manufacture a winch assembly that reduces noise associated with the winch assembly when used.

SUMMARY

This invention relates generally to a winch assembly. More particularly, this invention relates to a brake mechanism for a winch assembly.

According to one aspect of the invention, a brake mechanism for a winch assembly may include a ratchet coupled to a shaft of the winch, the ratchet including a plurality of teeth and a pawl engaging one of the plurality of teeth of the ratchet to lock the shaft from rotating in a first direction, and a pawl controller coupled to the shaft to engage and bias the pawl away from the plurality of teeth of the ratchet when the shaft is rotated in a second direction.

According to another aspect of the invention, a winch assembly for use with a boat lift may include a housing, a shaft extending through the housing, a ratchet coupled to the shaft and including a plurality of teeth, a pawl coupled to the housing and engaging one of the plurality of teeth of the ratchet to lock the shaft from rotating in an unwinding direction, and a pawl controller coupled to the shaft to engage and automatically bias the pawl away from the plurality of teeth of the ratchet when the shaft is rotated in a winding direction.

According to yet another aspect of the invention, a winch assembly for use with a boat lift may include a winch housing, a shaft extending through the winch housing, and a ratchet coupled to the shaft and including a plurality of teeth. The winch assembly further includes a pawl coupled to the winch housing and including a shoulder engaging one of the plurality of teeth of the ratchet to lock the shaft from rotating in an unwinding direction, and a pawl controller coupled to the shaft and defining a notch including a lower surface to engage the shoulder of the pawl and automatically bias the pawl away from the plurality of teeth of the ratchet when the shaft is rotated in a winding direction.

According to another aspect of the invention, a method for braking a winch assembly may include steps of: providing a ratchet including a plurality of teeth and a pawl; causing the pawl to engage one of the plurality of teeth of the ratchet to lock the ratchet from rotating in an unwinding direction; rotating the ratchet in a winding direction so that the pawl is biased away from the plurality of teeth of the ratchet; and stopping rotation so that the pawl engages one of the plurality of teeth of the ratchet to lock the ratchet from rotating in an unwinding direction.

The above summary of the present invention is not intended to describe each disclosed embodiment or every implementation of the present invention. Figures in the detailed description that follow more particularly exemplify embodiments of the invention. While certain embodiments will be illustrated and describing embodiments of the invention, the invention is not limited to use in such embodiments.

BRIEF DESCRIPTION OF THE DRAWINGS

The invention may be more completely understood in consideration of the following detailed description of various embodiments of the invention in connection with the accompanying drawings.

DETAILED DESCRIPTION

This invention relates generally to a winch assembly. More particularly, this invention relates to a brake mechanism for a winch assembly. While the present invention is not so limited, an appreciation of the various aspects of the invention will be gained through a discussion of the examples provided below.

A winch assembly including an example embodiment of a brake mechanism made in accordance with the present invention includes a winch housing and a shaft extending through the winch housing. A ratchet with a plurality of teeth is coupled to the shaft. A pawl is coupled to the winch housing to engage one of the plurality of teeth of the ratchet to lock the shaft from rotating in an unwinding direction. Further, a pawl controller is coupled to the shaft to engage and bias the pawl away from the plurality of teeth of the ratchet when the shaft is rotated in a winding direction.

Figure 1:
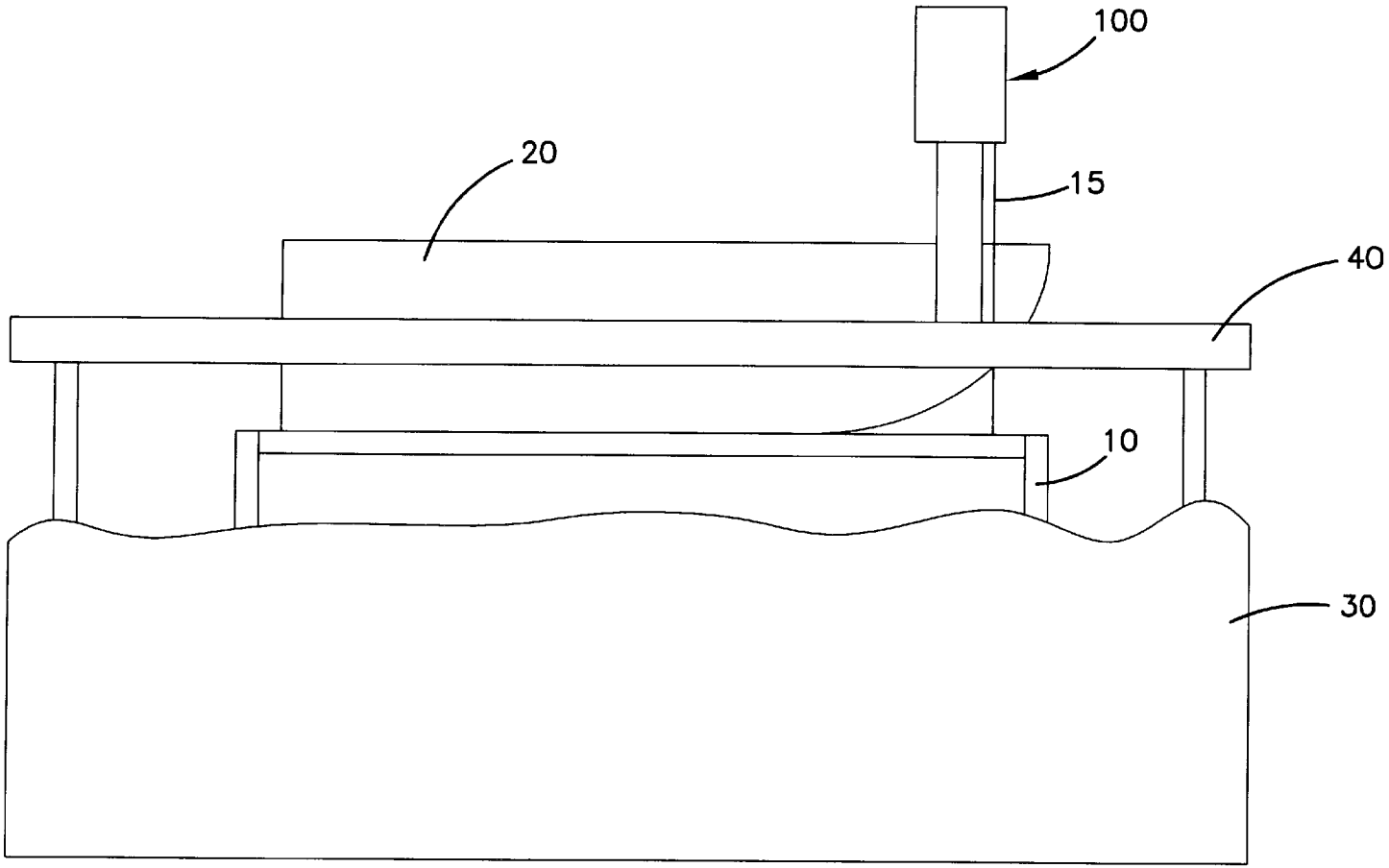
FIG. 1 is a schematic/block diagram of a boat and boat lift including an example embodiment of a winch assembly.

For example, in one application shown in FIG. 1, an example embodiment of a winch assembly 100 positioned on a dock 40 is coupled by a cable 15 to a boat lift 10 to raise and lower a boat 20 out of and into water 30. Through use of a pawl controller, as described in detail below, it is possible to reduce noise associated with the winch assembly 100 as the winch assembly 100 is used to lift the boat 20.

I. Winch Assembly

Figure 2:
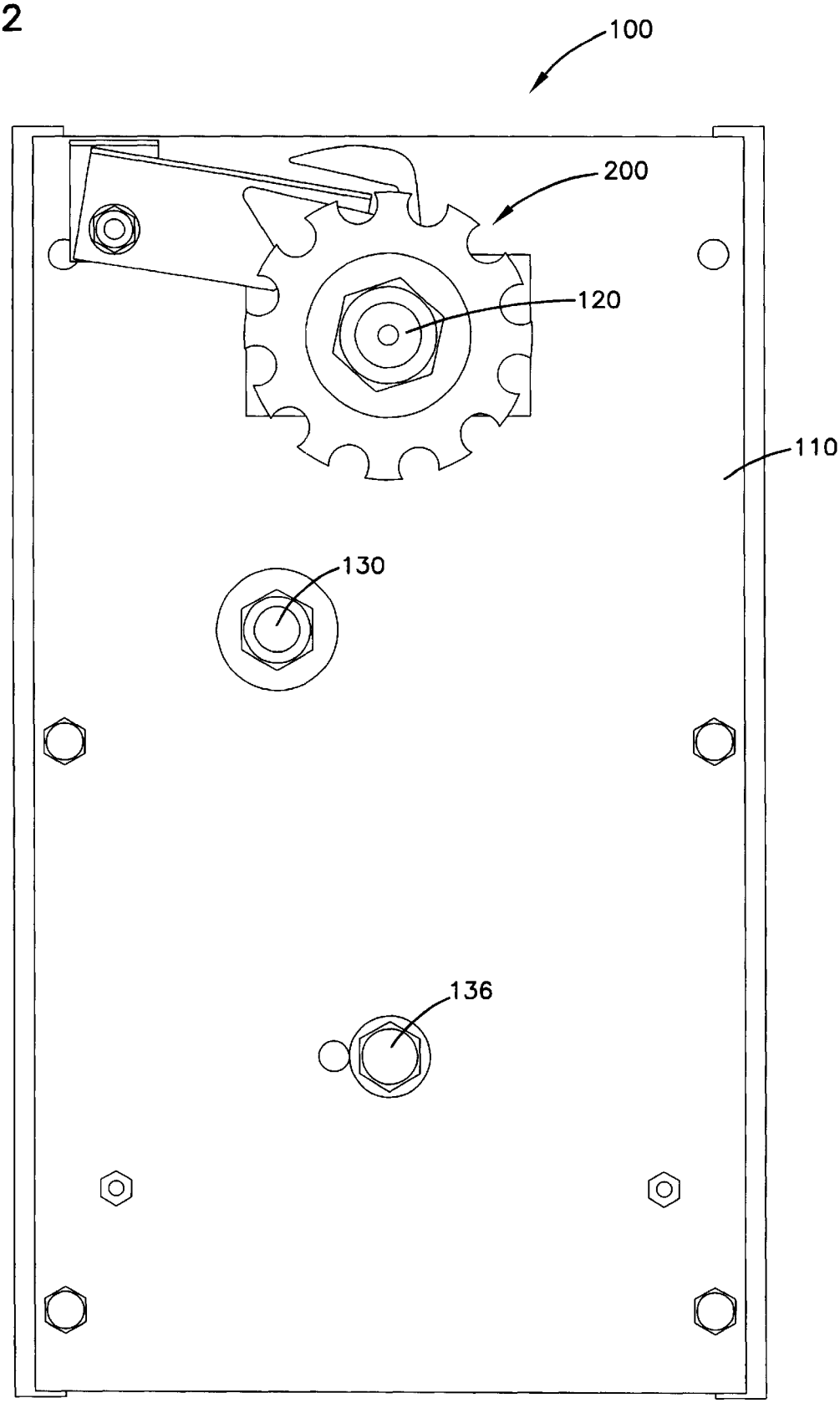
FIG. 2 is a front view of an example winch assembly with top and front covers removed and showing an example embodiment of a brake mechanism make in accordance with the present invention.
Figure 3:
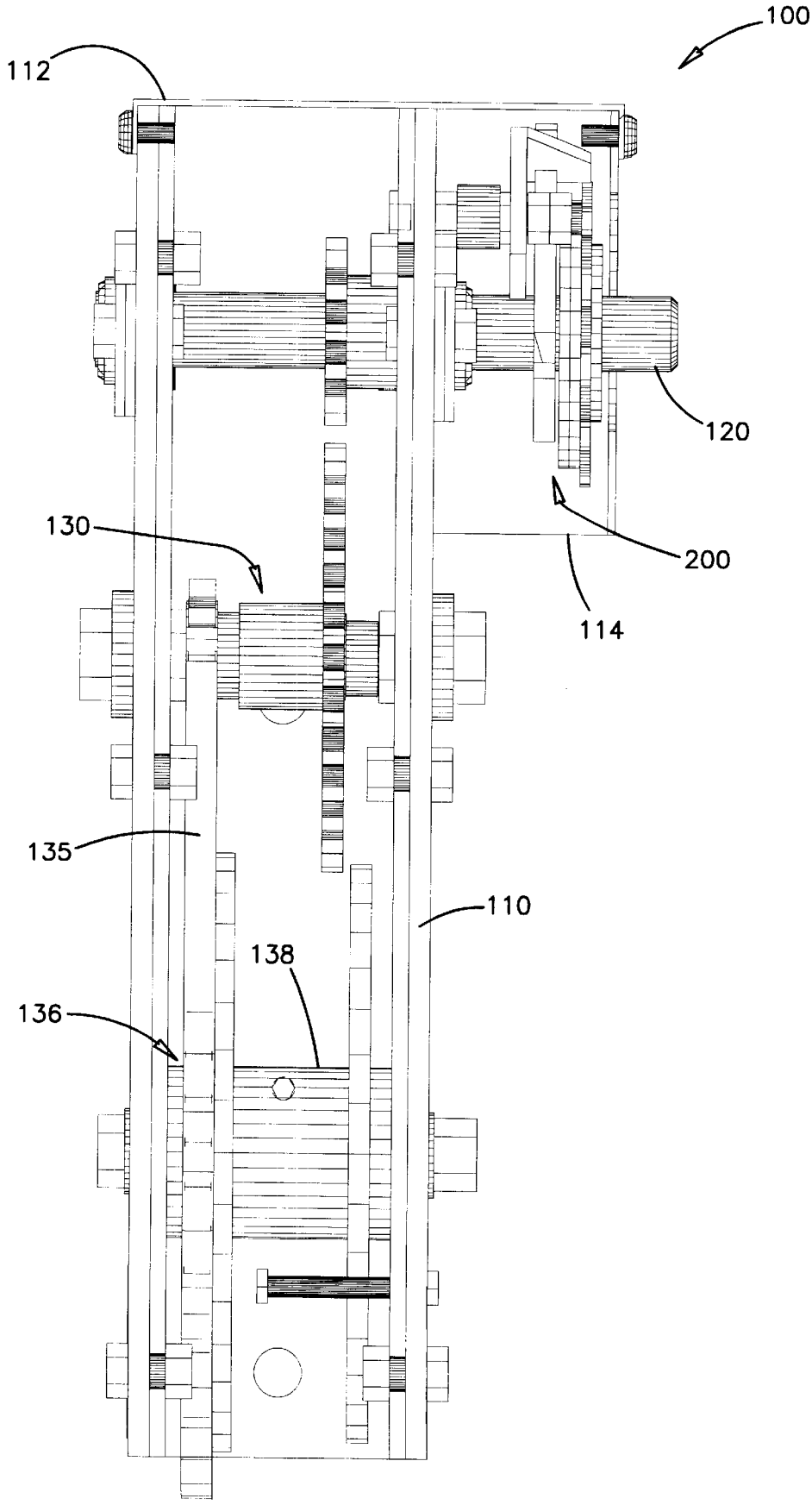
FIG. 3 is a side cross-sectional view of an example winch assembly illustrating an example brake mechanism.

Referring now to FIGS. 2–3, the example winch assembly 100 generally includes a housing 110 with top and front covers 112 and 114 (shown only in FIG. 3). A shaft 120 extends through the housing 110 and is coupled in the interior of the winch assembly 100 to a first reduction 130 by a link, typically a chain (not shown). The first reduction 130 is coupled to a second reduction 136 by a link 135. The second reduction 136 includes a spool 138 onto which a cable (e.g., cable 15) may be wound. An opposite end of the cable may, for example, exit the bottom of the winch assembly 100 and be coupled to a boat lift (e.g., 10).

Also included on the shaft 120 is an example embodiment of a brake mechanism 200, described in detail below.

II. Brake mechanism for Winch Assembly

Figure 4:
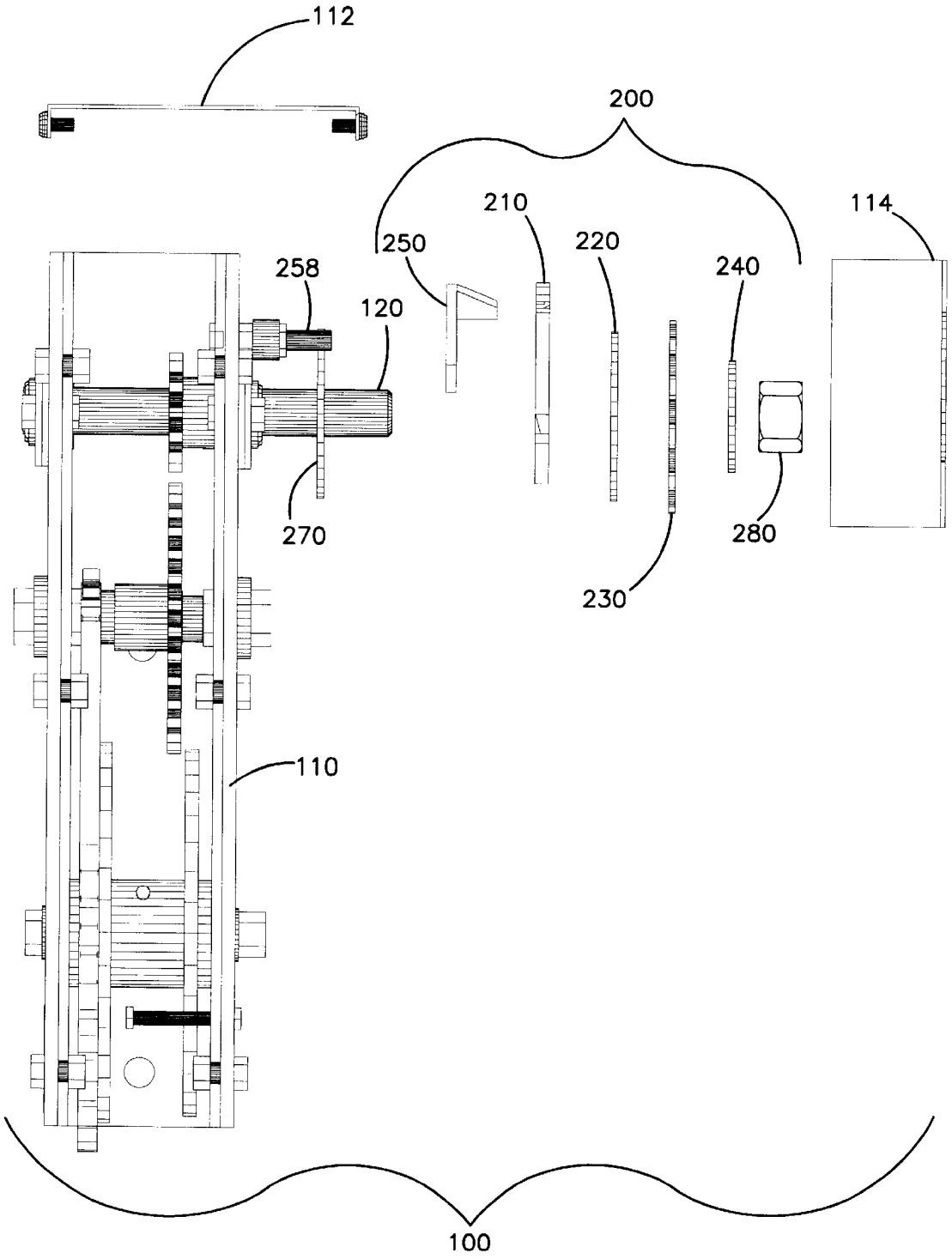
FIG. 4 is a side cross-sectional view as shown in FIG. 3 with the example brake mechanism in exploded form.
Figure 5:
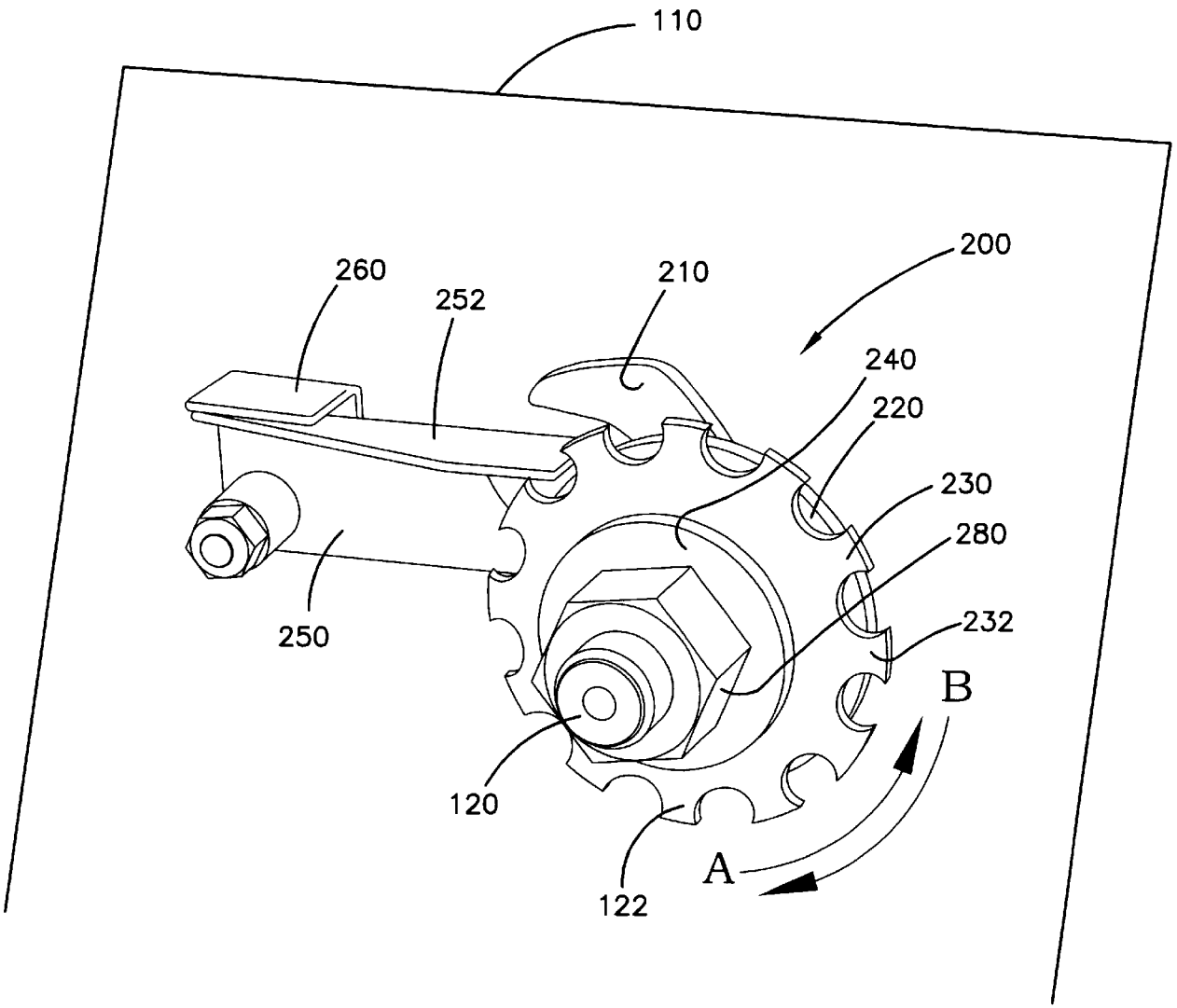
FIG. 5 is an enlarged perspective view of a portion of the example winch assembly of FIG. 2 illustrating the example brake mechanism.

As shown in FIGS. 4 and 5, the example brake mechanism 200 generally includes a pawl controller 210, a large brake pad 220, a ratchet 230, and a small brake pad 240, all disposed on the shaft 120. A stop 270 is fixedly coupled to the shaft 120. A nut 280 screws onto the end of the shaft 120 to hold the various pieces of the brake mechanism 200 onto the shaft 120. Also typically included, but not shown, is a handle (usually in the form of a large circular assembly) or other type of mechanism to allow a user to turn the nut 280 and thereby turn the shaft 120. In an alternative embodiment, a motor can be used to mechanically drive the shaft 120.

The example brake mechanism 200 further includes a pawl 250 pivotally coupled to a shaft 258 extending from the housing 110 and a pawl stop 260 (shown only in FIG. 5) coupled to the housing 110. The pawl 250 is rotatable about the shaft 258 and extends to the ratchet 230. The pawl 250 includes a shoulder 252 configured to engage one of a plurality of teeth 232 formed by the ratchet 230 when the shaft 120 attempts to rotate in an unwinding direction A. The shoulder 252 of the pawl 250 is further configured to ride over the teeth 232 of the ratchet 230 when the shaft 120 is rotated in a winding direction B.

Figure 6:
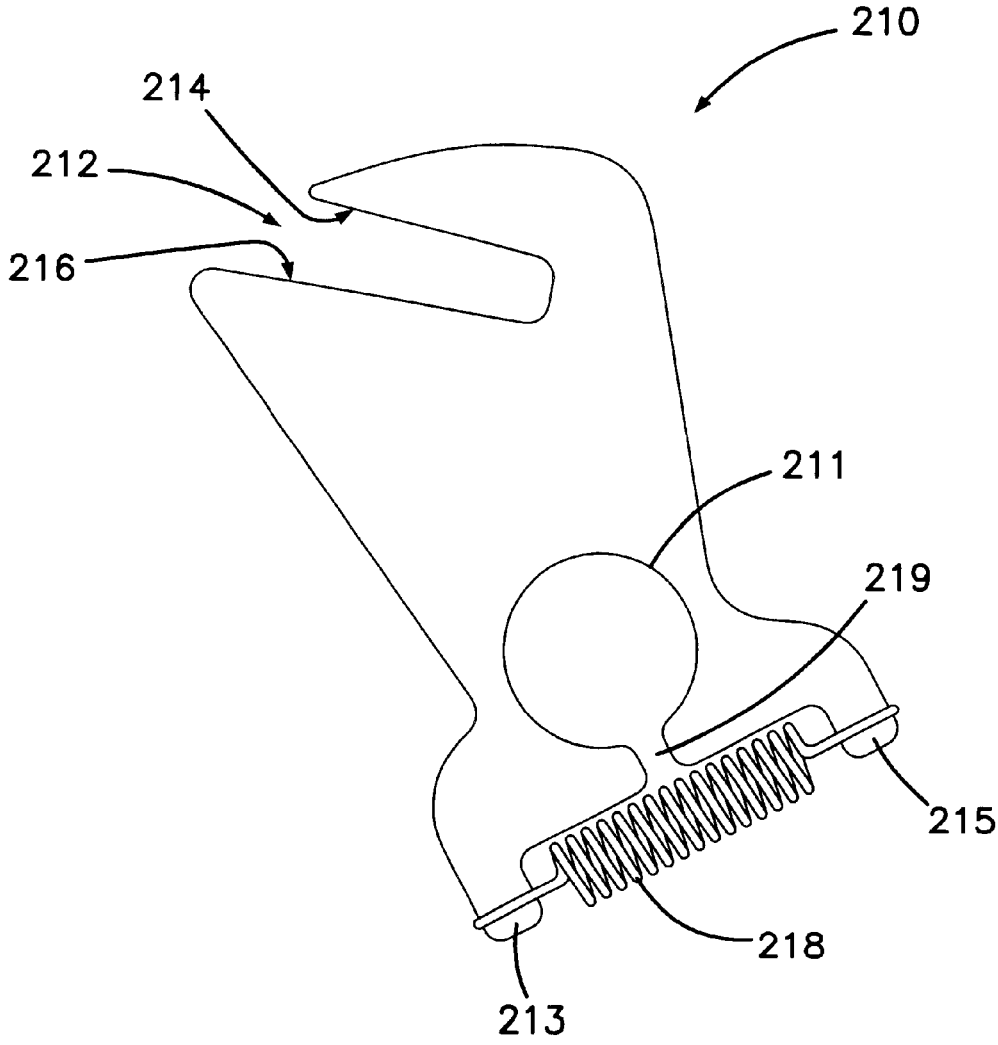
FIG. 6 is a plan view of an example embodiment of a pawl controller made in accordance with the present invention.

Referring now to FIG. 6, the pawl controller 210 defines a notch 212. The notch 212 includes an upper surface 214 and a lower surface 216 and is sized to receive a portion of the shoulder 252 of the pawl 250. The pawl controller 210 further defines an aperture 211 through which the shaft 120 may extend. A spring 218 is coupled to the pawl controller 210 at arms 213 and 215. The spring 218 may generate a frictional fit between the pawl controller 210 and the shaft 120 by biasing the arms 213 and 215 toward one another, thereby decreasing a gap 219 and the size of the aperture 211 surrounding the shaft 120. The frictional fit generated between the pawl controller 210 and the shaft 120 is sufficient to cause the pawl controller 210 to rotate upward slightly when the shaft 120 is rotated in the winding direction B and to rotate downward slightly when the shaft 120 is rotated in the unwinding direction A. Other biasing forces besides the spring 218 may also be used. For example, an elastic band may be used in place of the spring 218.

III. Method of Use

The example winch assembly 100 may be used as follows. When at rest, the shoulder 252 of the pawl 250 engages one of the plurality of teeth 232 of the ratchet 230 so that rotation of the shaft 120 in the unwinding direction A is restricted due to the torque generated by the weight of the load pulling on the cable (not shown).

Figure 7:
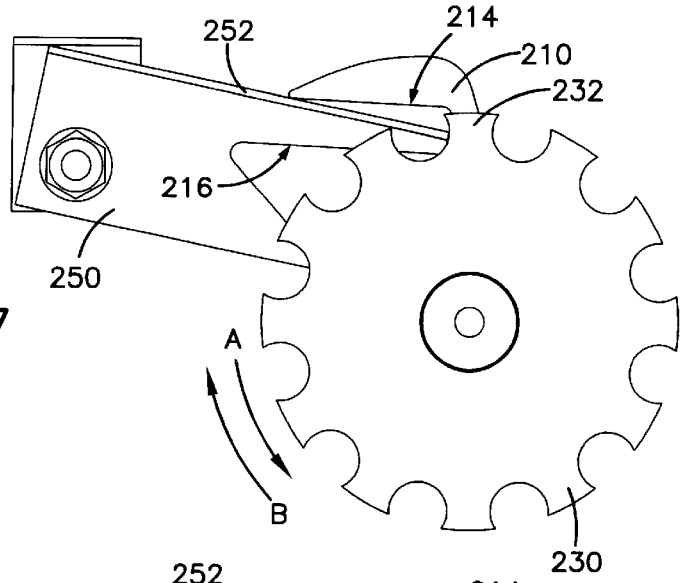
FIG. 7 is a plan view of an example embodiment of a brake mechanism shown in a locked position and including an example ratchet, pawl controller, and pawl.

For example, when the shaft 120 attempts to freely rotate in the unwinding direction A, the rotation causes friction generated by the large and small brake pads 220 and 240 to cause the nut 280 to tighten. This tightens the ratchet 230 and other associated components of the brake mechanism 200 against the stop 270. This causes the brake mechanism 200 to become "solid," meaning that the ratchet 230 can no longer rotate freely, but is now fixedly coupled to the stop 270. As noted earlier, the stop 270 is fixedly coupled to the shaft 120. Therefore, the ratchet 230 is now fixedly coupled to the shaft 120 through the stop 270, and the shaft 120 can no longer rotate without rotation of the ratchet 230 as well. However, the ratchet 230 cannot rotate in the unwinding direction A because the pawl 250 engages a tooth 232 on the ratchet 230. Therefore, rotation of the shaft 120 in the unwinding direction A is thereby stopped by the ratchet 230. This position is shown, for example, in FIG. 7, in which various components of the brake mechanism 200 have been removed for clarity purposes.

When the nut 280 is turned by a user in the unwinding direction A, the brake mechanism 200 loosens, decoupling the ratchet 230 from the stop 270, thereby allowing the shaft 120 to rotate freely without regard to the ratchet 230. The shaft 120 can thereby rotate in the unwinding direction A to unwind the cable (not shown) incrementally. The unwinding of the cable allows, for example, the boat lift to lower the boat into the water. Once rotation of the nut 280 by the user in the unwinding direction A is ceased, weight of the load causes the shaft 120 to continue to rotate slightly in the unwinding direction A because of the weight of the boat and boat lift acting against the winch assembly 100. This movement in the unwinding direction A causes the brake mechanism 200 to once again tighten and causes the pawl 250 to stop rotation of the ratchet 230 and shaft 120 in the unwinding direction A.

Figure 8:
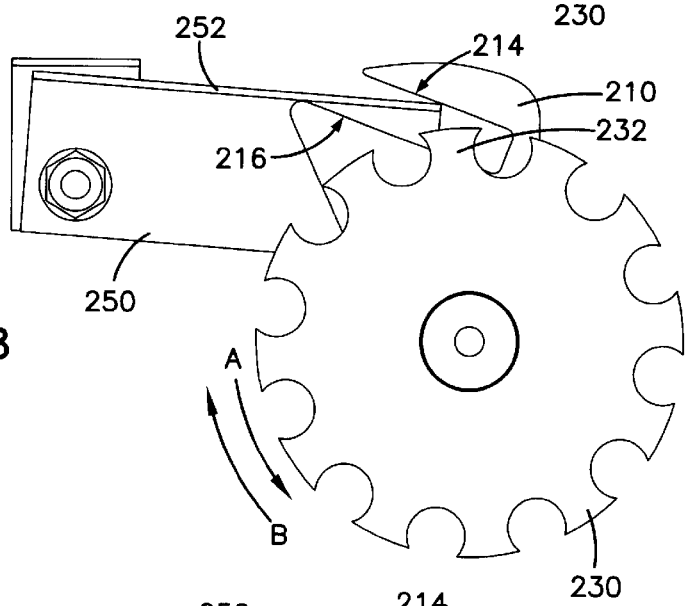
FIG. 8 is the example brake mechanism of FIG. 7 shown with the example pawl controller biasing the example pawl so that the pawl completely clears the example ratchet.

When the shaft 120 is turned by the user in the winding direction B, friction between the shaft 120 and the pawl controller 210 (generated by the spring 218) causes the pawl controller 210 to rotate up slightly in the winding direction B. As the pawl controller 210 rotates, the lower surface 216 of the pawl controller 210 contacts the shoulder 252 of the pawl 250 and biases the pawl 250 away from the teeth 232 of the ratchet 230. In the example embodiment, the pawl 250 is pushed far enough away so that the pawl 250 completely clears the teeth 232. See FIG. 8. In this position, while the shaft 120 is turned in the winding direction B, the pawl 250 remains biased away from the teeth 232 of the ratchet 230 by the pawl controller 210. If a pawl stop 260 is included on the winch assembly 100, the pawl controller 210 may bias the pawl 250 away from the ratchet 230 until the pawl 250 encounters the pawl stop 260, thereby limiting further movement of the pawl 250.

While the pawl controller 210 biases the pawl 250 away from the ratchet 230 during rotation in the winding direction B, contact between the pawl and the teeth 232 of the ratchet is reduced or eliminated. This reduction or elimination of contact may be advantageous to reduce or eliminate the noise associated with the contact of the pawl 250 with the ratchet 230 as the shaft 120 is rotated in the winding direction B.

When the force in the winding direction B on the shaft 120 is removed, the shaft 120 rotates slightly in the unwinding direction A because of the weight of the boat and boat lift acting against in the winch assembly 100. This slight movement in the unwinding direction A causes the pawl controller 210 to move in the same direction A, as well as causes the brake mechanism 200 to once again tighten. As the pawl controller 210 moves in the direction A, the lower surface 216 of the pawl controller 210 releases the pawl 250, allowing the shoulder 252 to engage a tooth 232 of the ratchet 230, thereby precluding further rotation of the shaft 120 in the direction A.

IV. Alternative Embodiments

Although the example winch assembly 100 with the example brake mechanism 200 is shown and described herein, other configurations and uses for the winch assembly and brake mechanism are possible. For instance, although the winch assembly 100 is described as being used in conjunction with a boat and boat lift in the example embodiment above, the winch assembly 100 and/or brake mechanism 200 may be used in a variety of other applications that include a ratchet and pawl and in which a reduction in noise is desirable.

Figure 9:
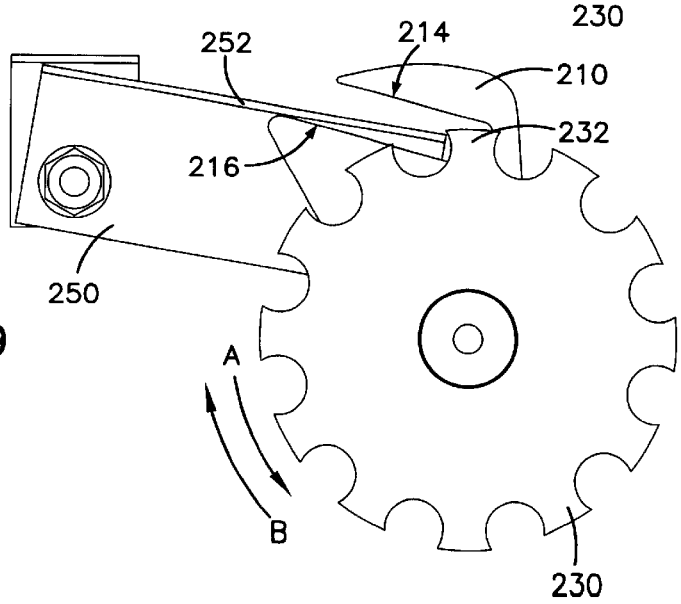
FIG. 9 is the example brake mechanism of FIG. 7 shown with the example pawl controller biasing the example pawl so that the pawl partially clears the example ratchet.

The structural components of the winch assembly 100 may also be modified. For example, the pawl stop 260 may be eliminated, if desired. In addition, the biasing force exerted against the pawl 250 by the pawl controller may be varied depending on the desired distance between the pawl 250 and the ratchet 230 during winding. For example, it may not be necessary to have the pawl 250 completely clear the teeth 232 of the ratchet 230 to achieve the desired reduction in noise. See, e.g., FIG. 9.

The present invention should not be considered limited to the particular examples described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the instant specification.

What is claimed is:

1. A brake mechanism for a winch assembly, the brake mechanism comprising:

a ratchet coupled to a shaft of the winch, the ratchet including a plurality of teeth;

a pawl engaging one of the plurality of teeth of the ratchet to lock the shaft from rotating in a first direction; and a pawl controller including a biasing member to frictionally couple the pawl controller to the shaft to engage and bias the pawl away from the plurality of teeth of the ratchet when the shaft is rotated in a second direction.

2. The brake mechanism of claim 1, wherein the pawl controller is configured to automatically biases the pawl away from the plurality of teeth when the shaft is rotated in the second direction.

3. The brake mechanism of claim 1, wherein the pawl controller defines a notch, and wherein the pawl engages the notch.

4. The brake mechanism of claim 3, wherein the pawl includes a shoulder positioned to engage the ratchet, and wherein the notch of the pawl controller is sized to receive the shoulder of the pawl.

5. The brake mechanism of claim 1, further comprising a pawl stop positioned to limit movement of the pawl.

6. The brake mechanism of claim 1, wherein the pawl controller moves the pawl to completely clear the plurality of teeth of the ratchet.

7. A winch assembly for use with a boat lift, the winch assembly comprising:

a housing;

a shaft extending through the housing;

a ratchet coupled to the shaft and including a plurality of teeth;

a pawl coupled to the housing and engaging one of the plurality of teeth of the ratchet to lock the shaft from rotating in an unwinding direction; and a pawl controller coupled to the shaft to engage and automatically bias the pawl away from the plurality of teeth of the ratchet when the shaft is rotated in a winding direction, wherein the pawl controller defines a notch, and wherein the pawl engages the notch.

8. The winch assembly of claim 7, wherein the pawl controller includes a biasing member to frictionally couple the pawl controller to the shaft.

9. The winch assembly of claim 8, wherein the biasing member is a spring.

10. The winch assembly of claim 7, wherein the pawl includes a shoulder positioned to engage the ratchet, and wherein the notch of the pawl controller is sized to receive the shoulder of the pawl.

11. The winch assembly of claim 7, further including a pawl stop on the winch housing positioned to limit movement of the pawl.

12. The winch assembly of claim 7, wherein the pawl controller is positioned on the shaft closer to the winch housing than the ratchet, and the winch assembly further comprises a brake mechanism pad positioned between the ratchet and an end of the shaft, the brake mechanism pad creating a frictional biasing force to lock the shaft from rotating in an unwinding direction.

13. The winch assembly of claim 7, wherein the pawl controller is configured to move the pawl to completely clear the plurality of teeth of the ratchet.

14. A winch assembly for use with a boat lift, the winch assembly comprising:

a winch housing;

a shaft extending through the winch housing;

a ratchet coupled to the shaft and including a plurality of teeth;

a pawl coupled to the winch housing and including a shoulder engaging one of the plurality of teeth of the ratchet to lock the shaft from rotating in an unwinding direction; and a pawl controller coupled to the shaft and defining a notch including a lower surface to engage the shoulder of the pawl and automatically bias the pawl away from the plurality of teeth of the ratchet when the shaft is rotated in a winding direction.

* * * * *